US007104819B2

(12) United States Patent
Yamaoka

(10) Patent No.: US 7,104,819 B2
(45) Date of Patent: Sep. 12, 2006

(54) CONNECTOR WITH EASILY MOUNTABLE AND EFFICIENTLY OPERABLE LEVER

(75) Inventor: Atsushi Yamaoka, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/284,838

(22) Filed: Nov. 22, 2005

(65) Prior Publication Data

US 2006/0110960 A1 May 25, 2006

(30) Foreign Application Priority Data

Nov. 24, 2004 (JP) ..... 2004-339428

(51) Int. Cl.
*H01R 13/62* (2006.01)

(52) U.S. Cl. ..... 439/157; 439/153

(58) Field of Classification Search ..... 439/157, 439/372, 153, 160, 152
See application file for complete search history.

(56) References Cited

U.S. PATENT DOCUMENTS 5,401,179 A 3/1995 Shinchi et al. ..... 439/157
6,485,317 B1 * 11/2002 Gundermann et al. ..... 439/157
6,679,711 B1 * 1/2004 Takahashi ..... 439/157
6,736,655 B1 * 5/2004 Martin et al. ..... 439/157
6,767,231 B1 * 7/2004 Martin et al. ..... 439/157
6,805,564 B1 * 10/2004 Shinozaki et al. ..... 439/157
2003/0082940 A1 * 5/2003 Yamashita ..... 439/157

* cited by examiner

*Primary Examiner*—Michael C. Zarroli
(74) *Attorney, Agent, or Firm*—Gerald E. Hespos; Anthony J. Casella

(57) ABSTRACT

A connector has lever-mounting portions (22) on side surfaces of a female housing (5), and forwardly-open introduction grooves (23) penetrate through the lever-mounting portions (22). A lever (21) is mounted to the lever-mounting portions (22) and has a rotary shaft (24) with a gear piece (30) for engaging a tooth (7) of a male housing (1). A projection (31) is disposed on the lever (21) rearward from the rotary shaft (24). The lever (21) is slid along outer surfaces of the lever-mounting portions (22) with the rotary shafts (24) and the projections (31) fit in the introduction grooves (23). The rotary shafts (31) fit in return prevention portions (25) at the ends of the introduction grooves (23) to prevent the lever (21) from returning to an initial position. The lever (21) can be rotated to connect the housings (1, 5).

18 Claims, 22 Drawing Sheets

CONNECTOR WITH EASILY MOUNTABLE AND EFFICIENTLY OPERABLE LEVER

BACKGROUND OF THE INVENTION

1. Field of the Invention

The invention relates to a connector having a lever.

2. Description of the Related Art

U.S. Pat. No. 5,401,179 discloses a connector with a housing that is connectable with a mating housing. A lever is mounted rotatably to a rotary shaft of the housing and has a cam groove. The mating housing has a cam pin that can engage with the cam groove on the lever. The cam pin and the cam groove cooperate as the lever is rotated to connect the housing and the mating housing.

The lever is substantially U-shaped and has two side plates and an operational piece that connects the side plates to each other. Rotary shafts project from outer surfaces of the housings and fit into the mounting holes in the side plates.

This construction necessitates the forcible opening of both side plates of the lever outwardly so that both mounting holes can be fit on the rotary shaft. More specifically, it is necessary to match the position of the mounting holes to the rotary shaft while resisting the elastic force of the side plates. Thus this construction has inherent mounting difficulties for an operator.

The invention has been completed in view of the above-described situation. Therefore it is an object of the invention to mount a lever easily on a connector housing.

SUMMARY OF THE INVENTION

The invention relates a connector with first and second housings that can be fit together. The connector also has a lever with a side plate and an operation portion at one end of the side plate. A rotary shaft extends from an end of the side plate opposite the operation portion and a projection is formed on the rotary shaft. A lever-mounting portion is provided on the first housing and can accommodate the lever so that an outer surface of the lever-mounting portion confronts the side plate. A receiving portion is provided on the second housing and engages a force exerting portion on the lever to displace the housings in a fit-in direction when the lever is operated.

An insertion opening is formed at one end of the lever-mounting portion and can receive the rotary shaft so that the lever can be mounted along the outer surface of the lever-mounting portion. Additionally, an introduction groove penetrates through the lever-mounting portion and extends along the lever mounting direction.

In the above-described construction, the rotary shaft can be disposed rotatably at an end of the introduction groove, and the projection of the rotary shaft can be locked to a rear side of an edge of an opening at the end of the introduction groove to prevent the side plate from moving out along an axial direction of the rotary shaft.

The connector further includes a return prevention portion between the lever and the lever-mounting portion. The return prevention portion locks to a mating member to prevent the rotary shaft from returning in a direction opposite to the lever-mounting direction in the introduction groove after the rotary shaft reaches the end of the introduction groove. However, an operator can perform an operation of rotating the lever.

The projection preferably has a first engaging tooth that projects radially out from an outer surface of the rotary shaft.

An accommodation space is formed between the lever-mounting portion and an outer surface of the first housing for accommodating the engaging tooth. A second engaging tooth is provided at the receiving portion of the second housing and penetrates into the accommodation space, when the housings are fit together. The first and second engaging teeth engage each other when the housings initially are fit together. The housings fit together further due to progress of engagement between the first and second engaging teeth caused by operation of the lever.

Lever-mounting portions may be disposed on both side surfaces of the first housing, and the lever may have two side plates connected with each other by the operation portion. Thus, the lever is substantially U-shaped and can straddle the first housing. A projection is formed on an inner surface of each of the side plates for preventing the lever from returning in a direction opposite to the lever-mounting direction. A circular arc-shaped locking groove is formed on the outer surface of the lever-mounting portion, and is disposed around an axis of the rotary shaft. The projection can be locked in the locking groove, but can be displaced along the locking groove.

The rotary shaft is fit into the insertion opening, with the side plates of the lever confronting the lever-mounting portion. The lever then is slid along the introduction groove. The rotary shaft is locked to the return prevention portion when the rotary shaft reaches the end of the introduction groove. Thus, the lever is held at the end of the introduction groove and cannot be displaced from the lever-mounting portion.

As described above, the lever can be mounted on the lever-mounting portion along the outer surface of the lever-mounting portion. Thus, the lever-mounting operation can be accomplished easily, as compared with the conventional lever-mounting operation which is performed by opening the side plates outward.

The first and second engaging teeth engage when the housings initially fit together and then pull the housings together as the lever is operated. The first and second engaging teeth also prevent removal of the lever. Thus, the construction of the connector is simplified.

The rotary shafts fit in the respective insertion openings of the first housing as the lever is slid along the introduction groove. The return prevention projection then fits into the locking groove when the rotary shaft reaches the end of the introduction groove to prevent the return of the lever. The return prevention projection is displaced along the locking groove as the lever is operated to guide the movement of the lever.

DETAILED DESCRIPTION OF THE PREFERRED EMBODIMENTS

Figure 1:
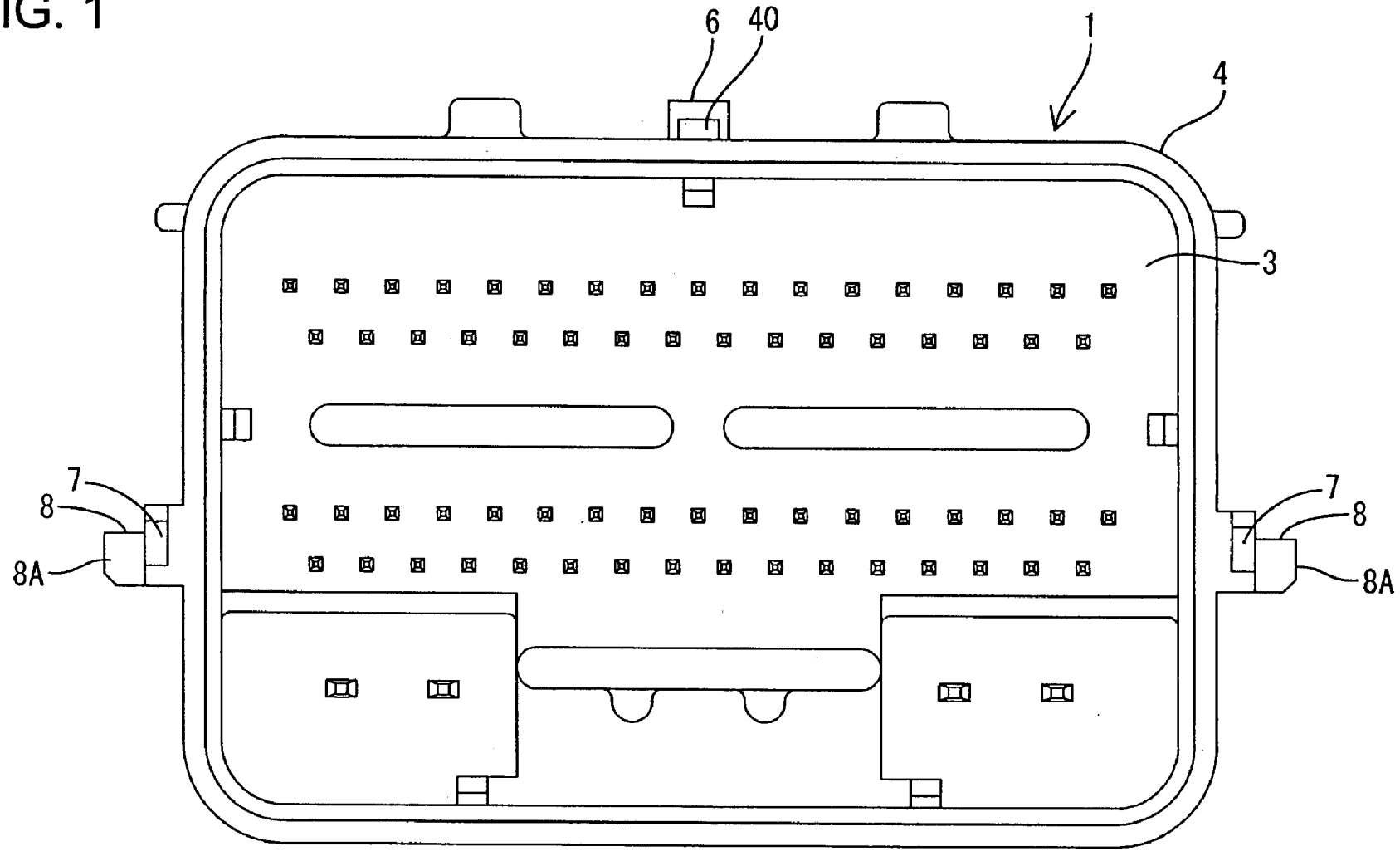
FIG. 1 is a front view showing a male connector housing.
Figure 2:
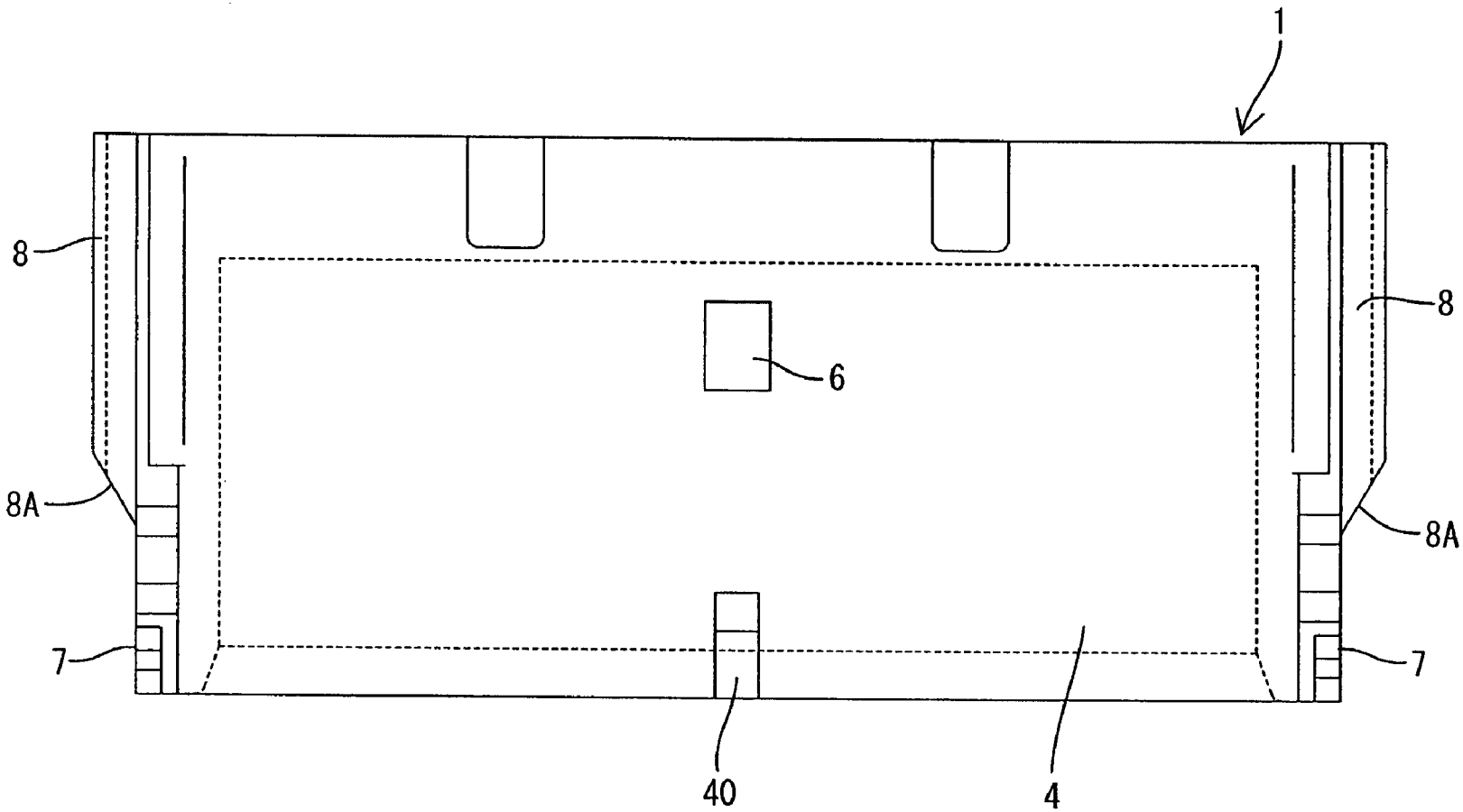
FIG. 2 is a plan view showing the male connector housing.
Figure 3:
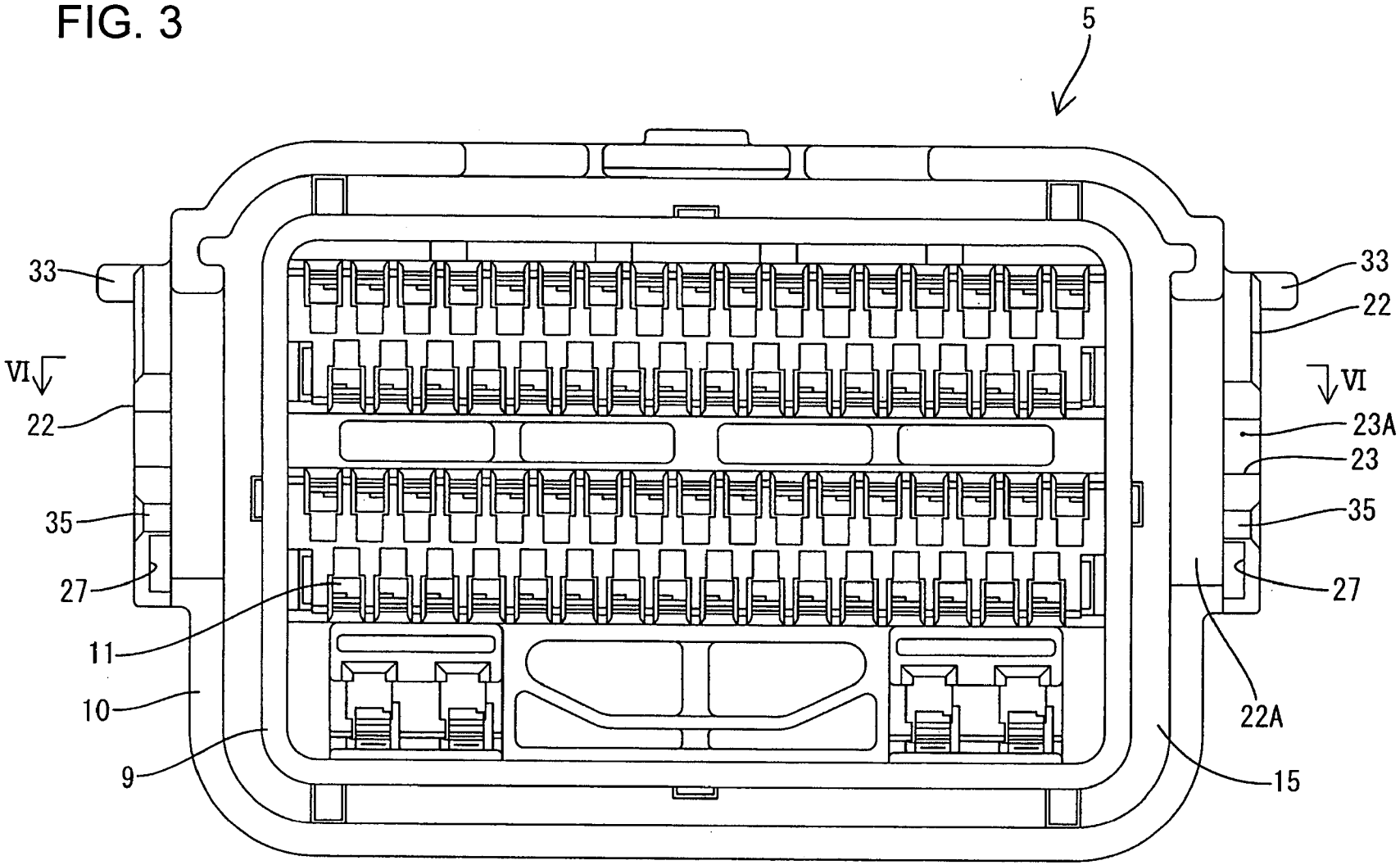
FIG. 3 is a front view showing a female connector housing.
Figure 4:
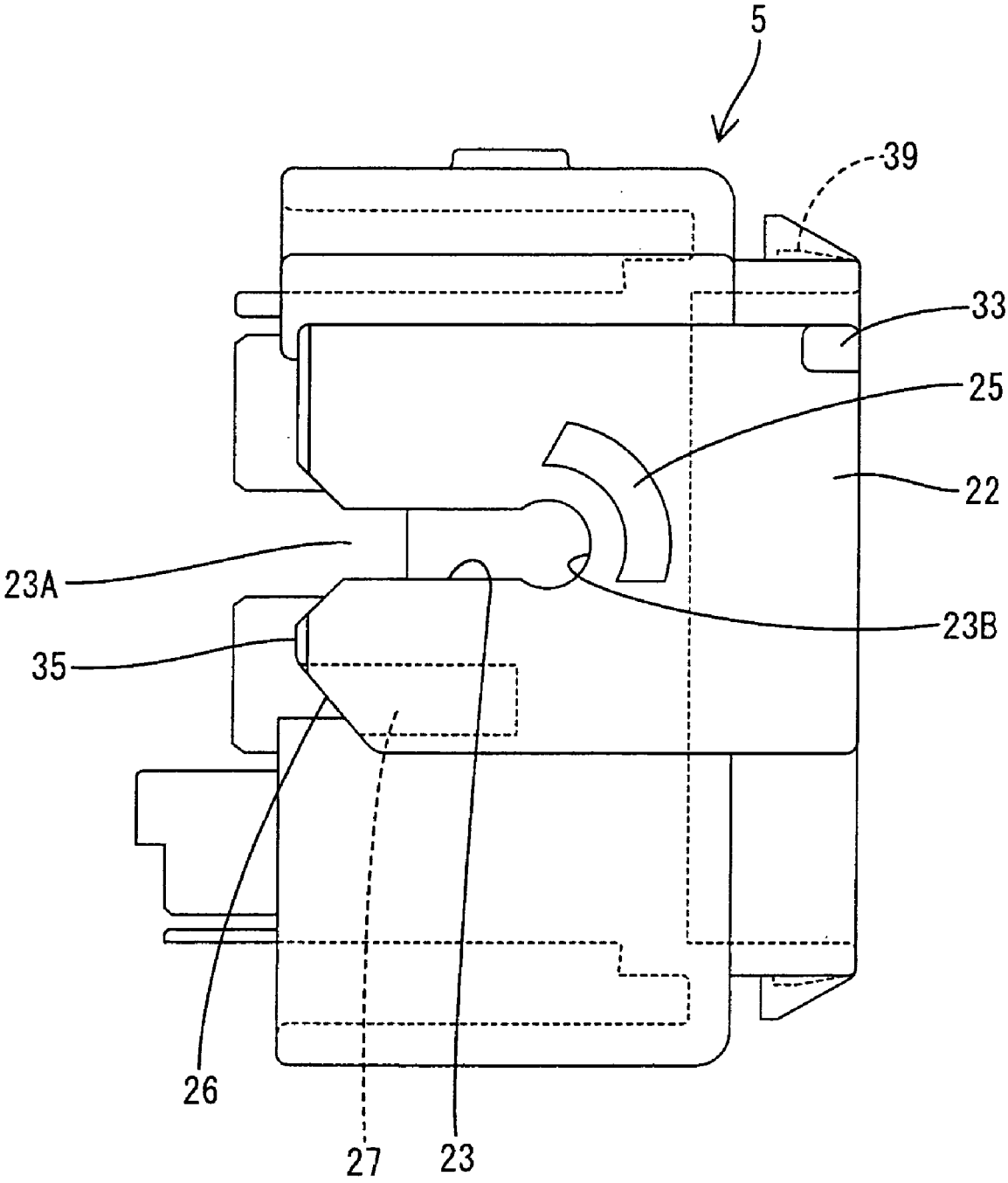
FIG. 4 is a side view showing the female connector housing.
Figure 5:
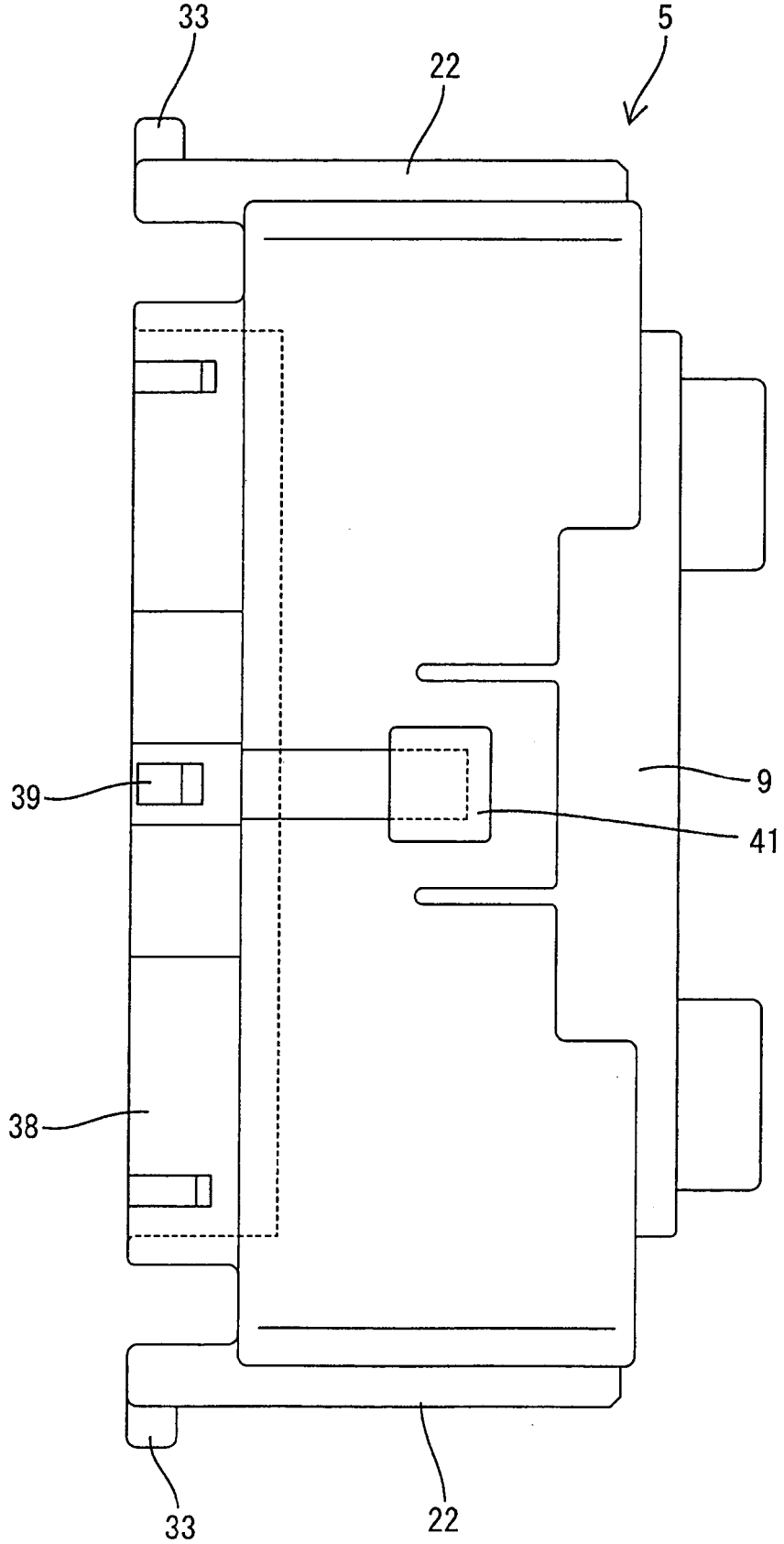
FIG. 5 is a plan view showing the female connector housing.
Figure 6:
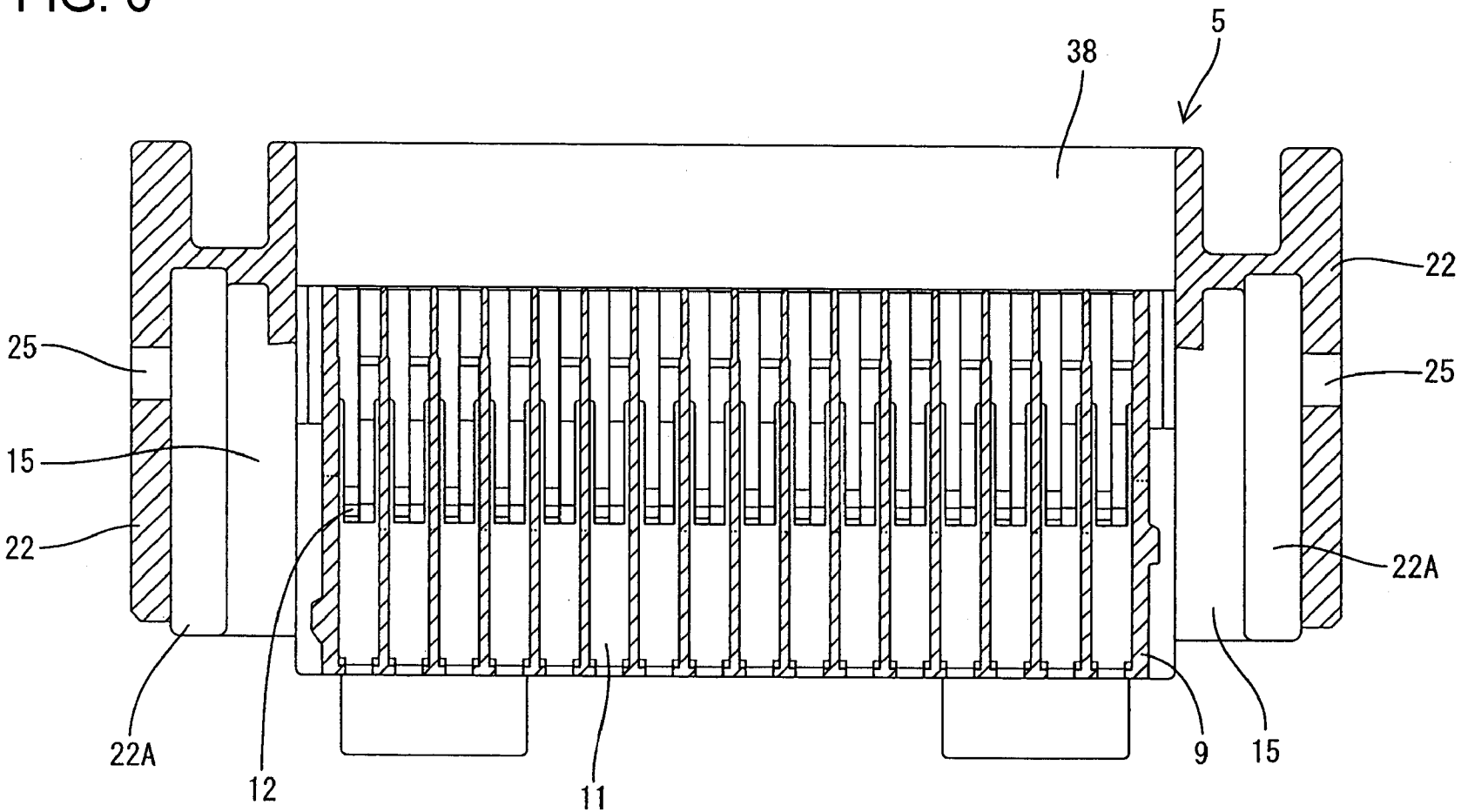
FIG. 6 is a sectional view taken along a line VI–VI of FIG. 3.
Figure 7:
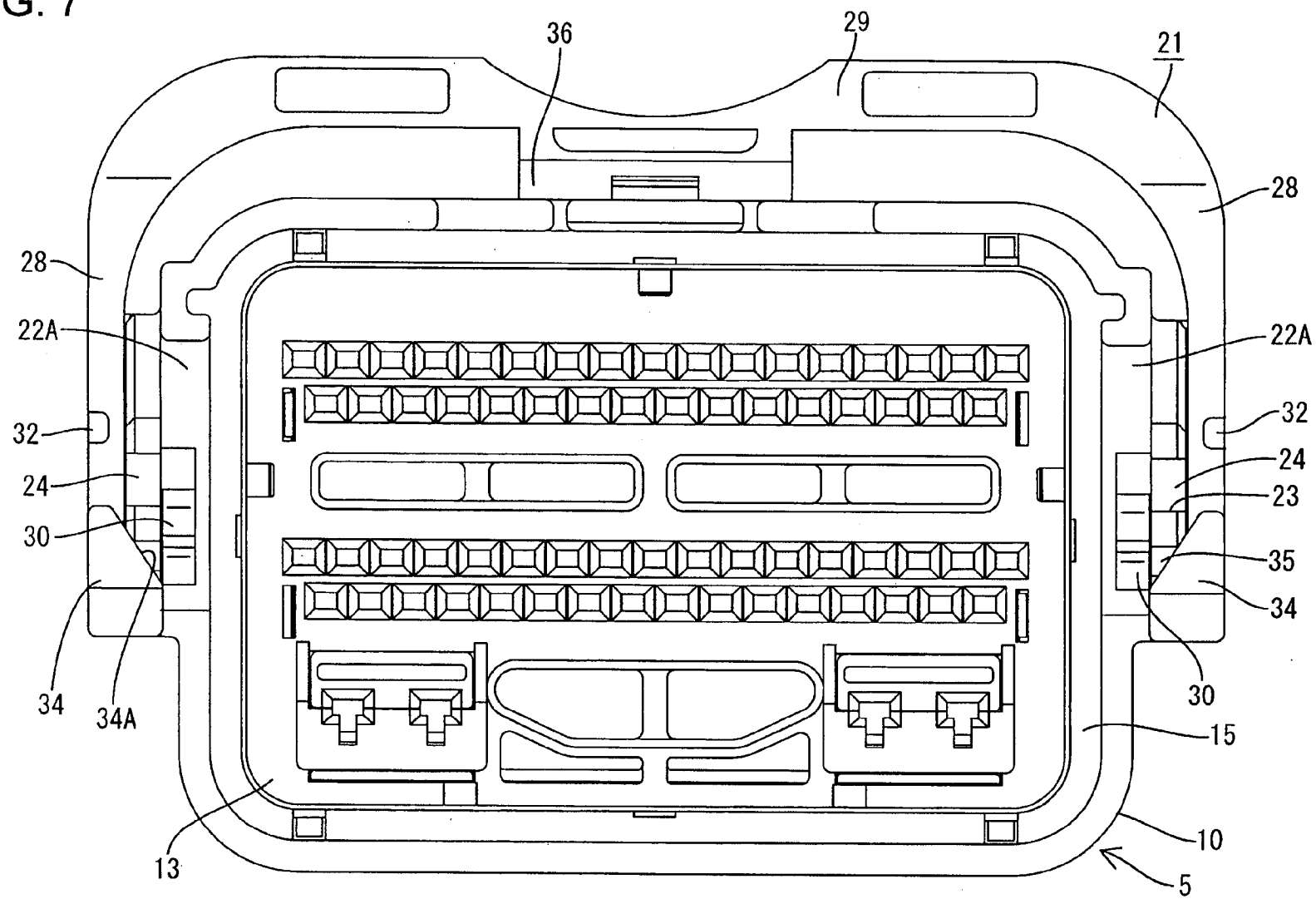
FIG. 7 is a front view showing the female connector.
Figure 8:
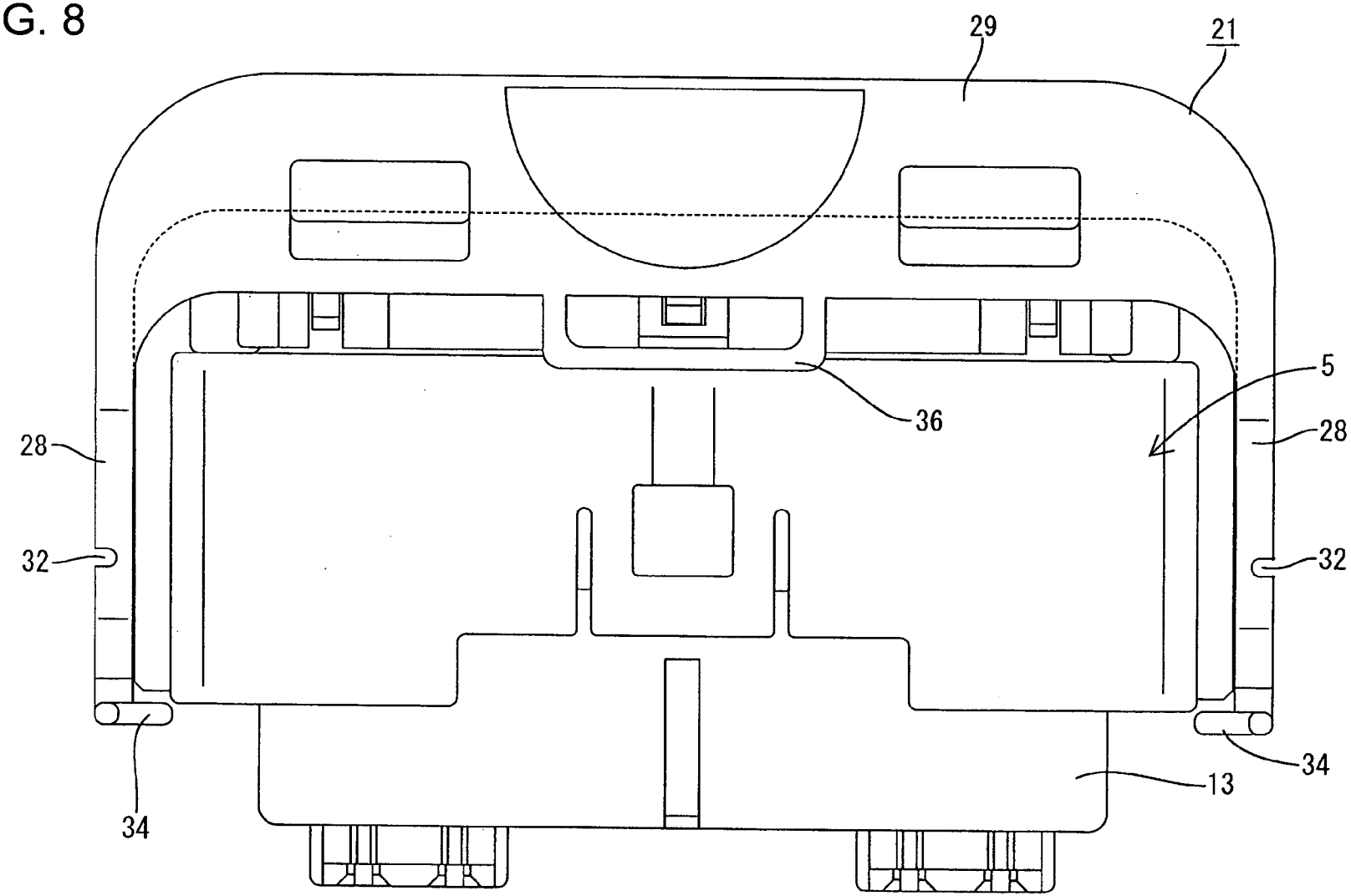
FIG. 8 is a plan view showing the female connector.
Figure 9:
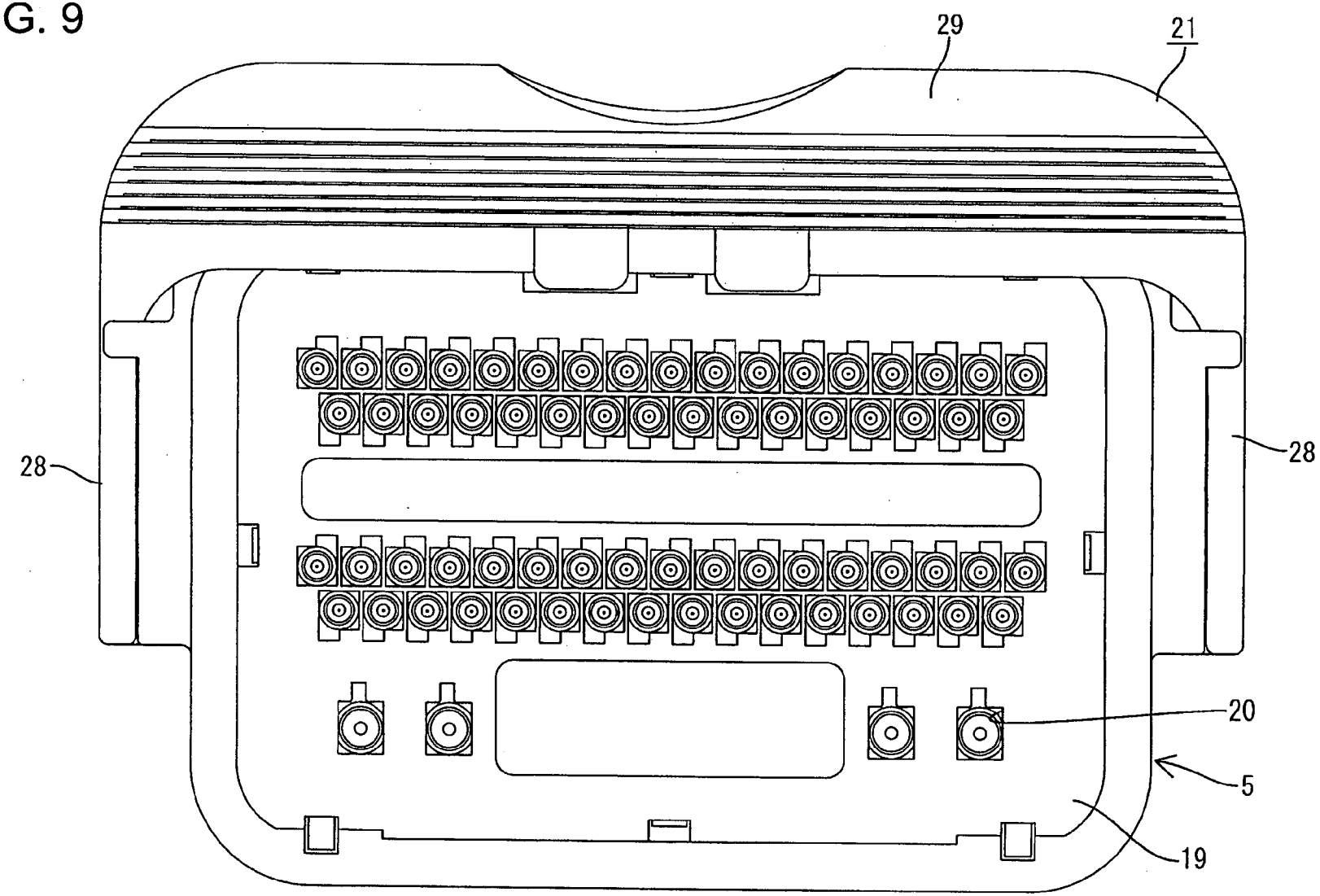
FIG. 9 is a rear view showing the female connector.
Figure 10:
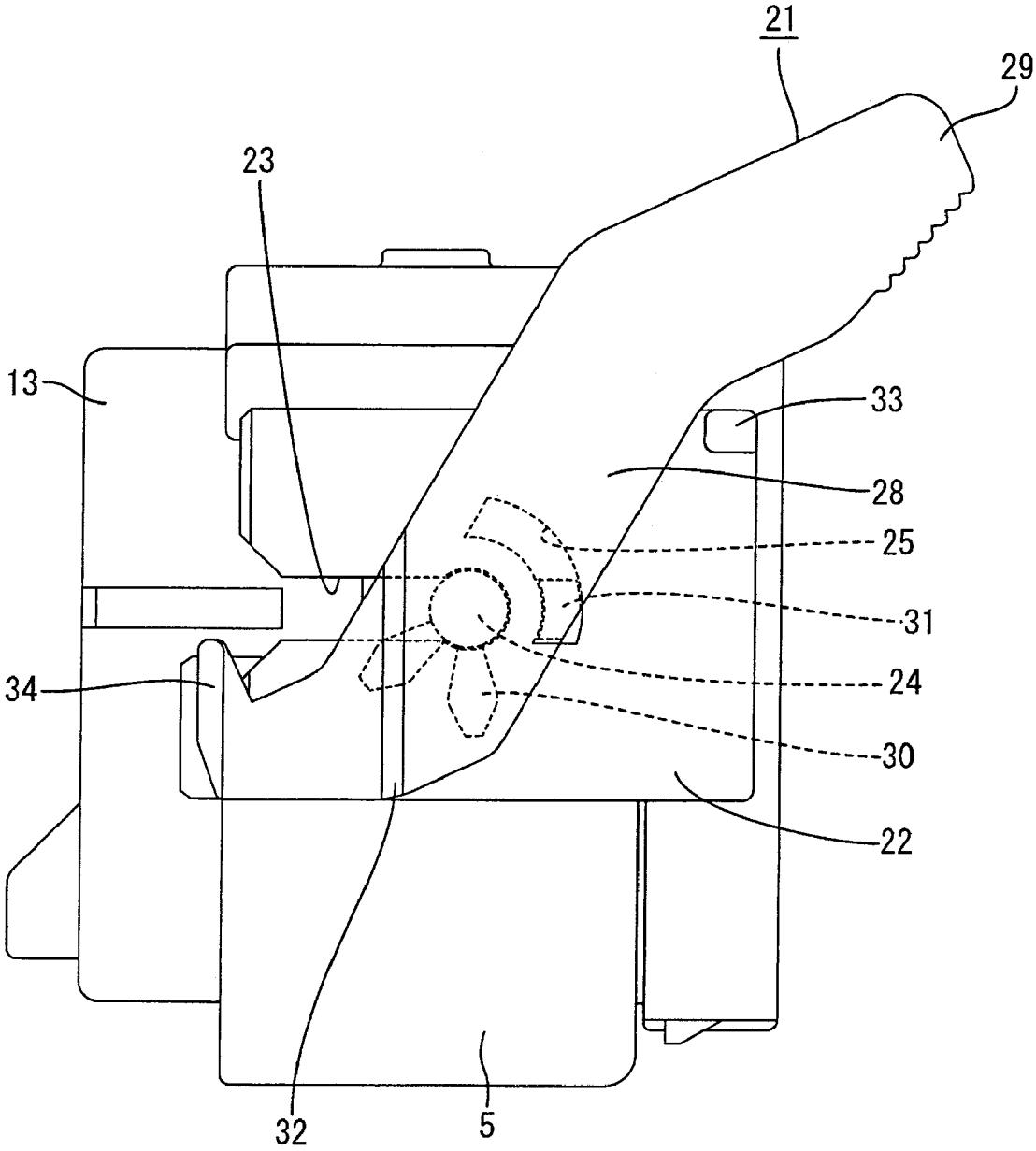
FIG. 10 is a side view showing the female connector.
Figure 11:
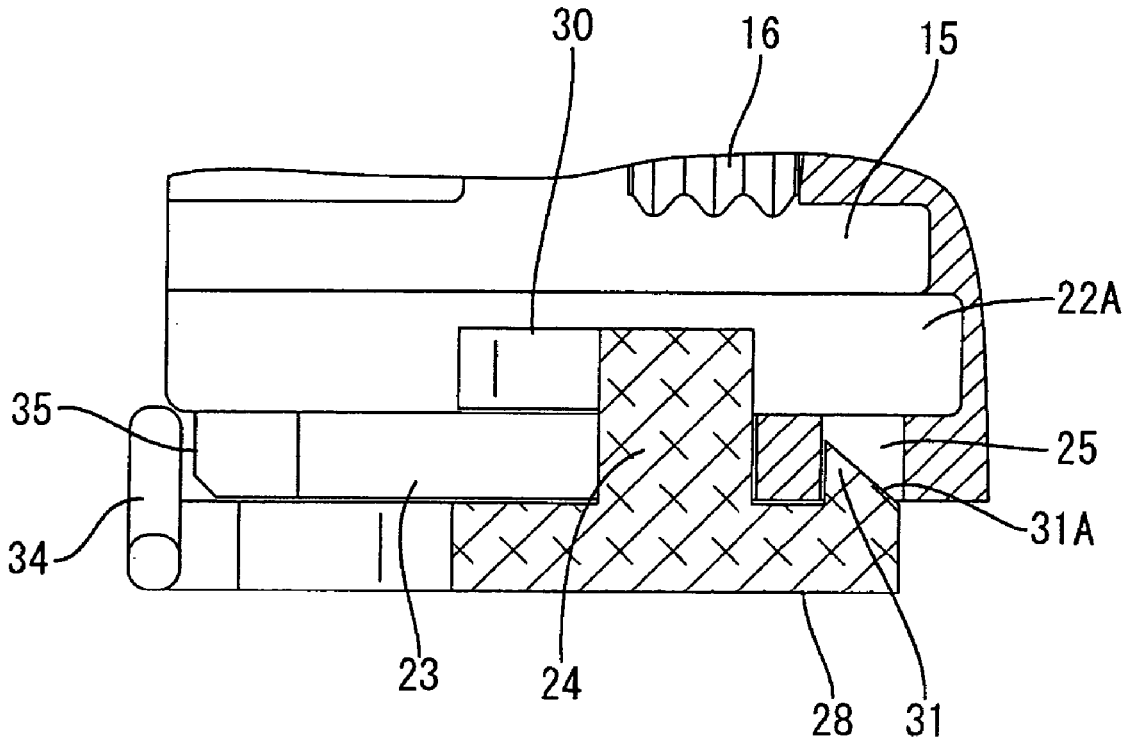
FIG. 11 is a sectional view showing a rotary shaft.

A male connector in accordance with the invention includes a male housing 1, as shown in FIGS. 1 and 2, and male terminal fittings 2 are mounted in a male terminal accommodation portion 3 of the male housing 1. A square pillar-shaped hood 4 projects forward from the male terminal accommodation portion 3 and tabs of the male terminal fittings 2 project forward into the hood 4. The male housing 1 can be connected with a female housing 5. A locking projection 6 is formed at a widthwise central portion of on an upper surface of the male housing 1 near the male terminal accommodation portion 3 for locked engagement with the female housing 5.

An engaging tooth 7 is formed on each side surface of the male housing 1 in the vicinity of an opening of the hood 4. The engaging tooth 7 projects up and out in the widthwise direction of the male housing 1. A guide 8 is formed behind the engaging tooth 7 and projects in the widthwise direction of the male housing 1. The guide 8 projects higher than the engaging tooth 7 in the widthwise direction of the male housing 1 and a tapered surface 8A is formed on the front-end surface of the guide piece 8.

Figure 16:
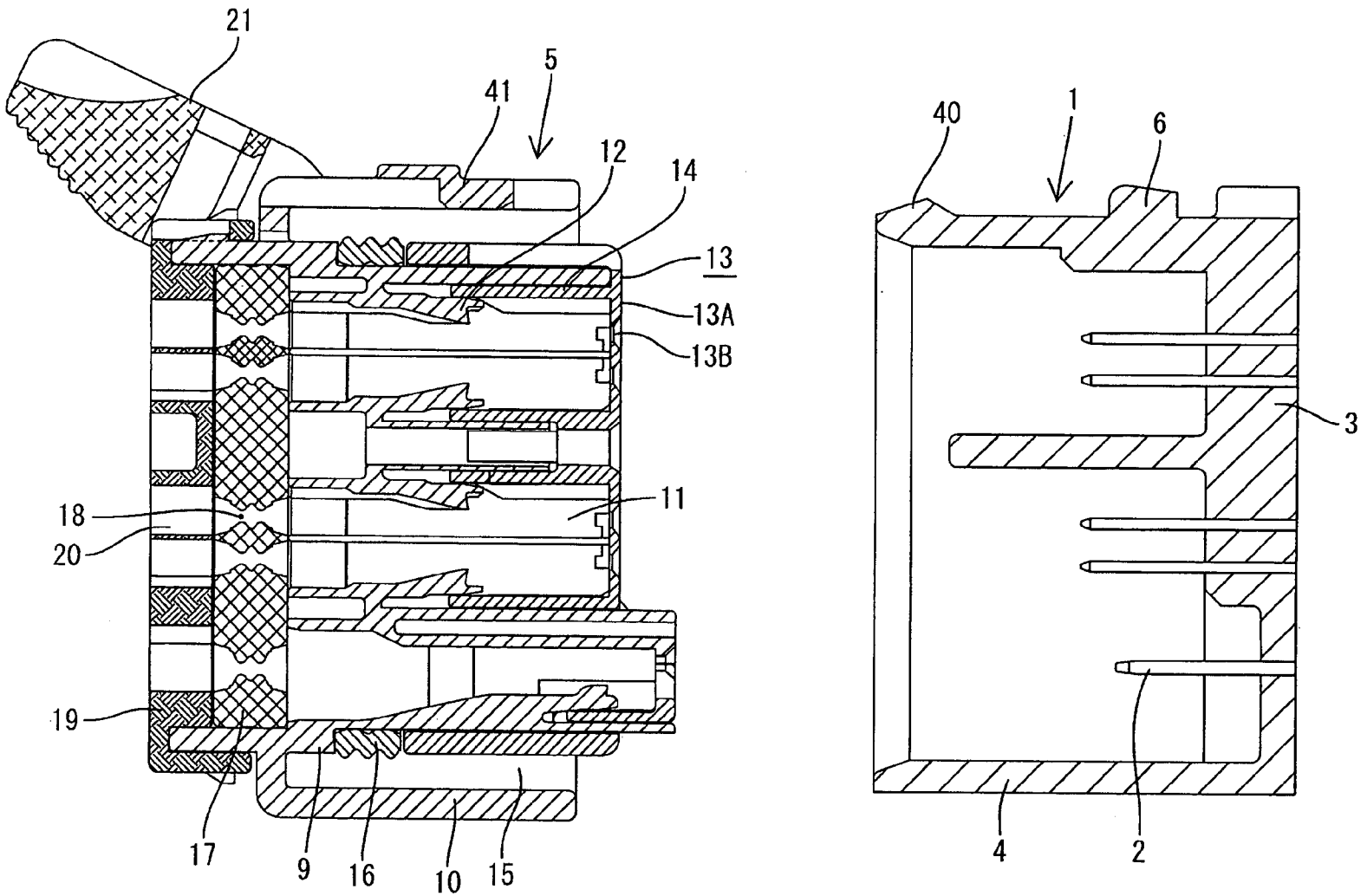
FIG. 16 is a sectional side elevation showing the state before the female and male connectors are fit together.
Figure 17:
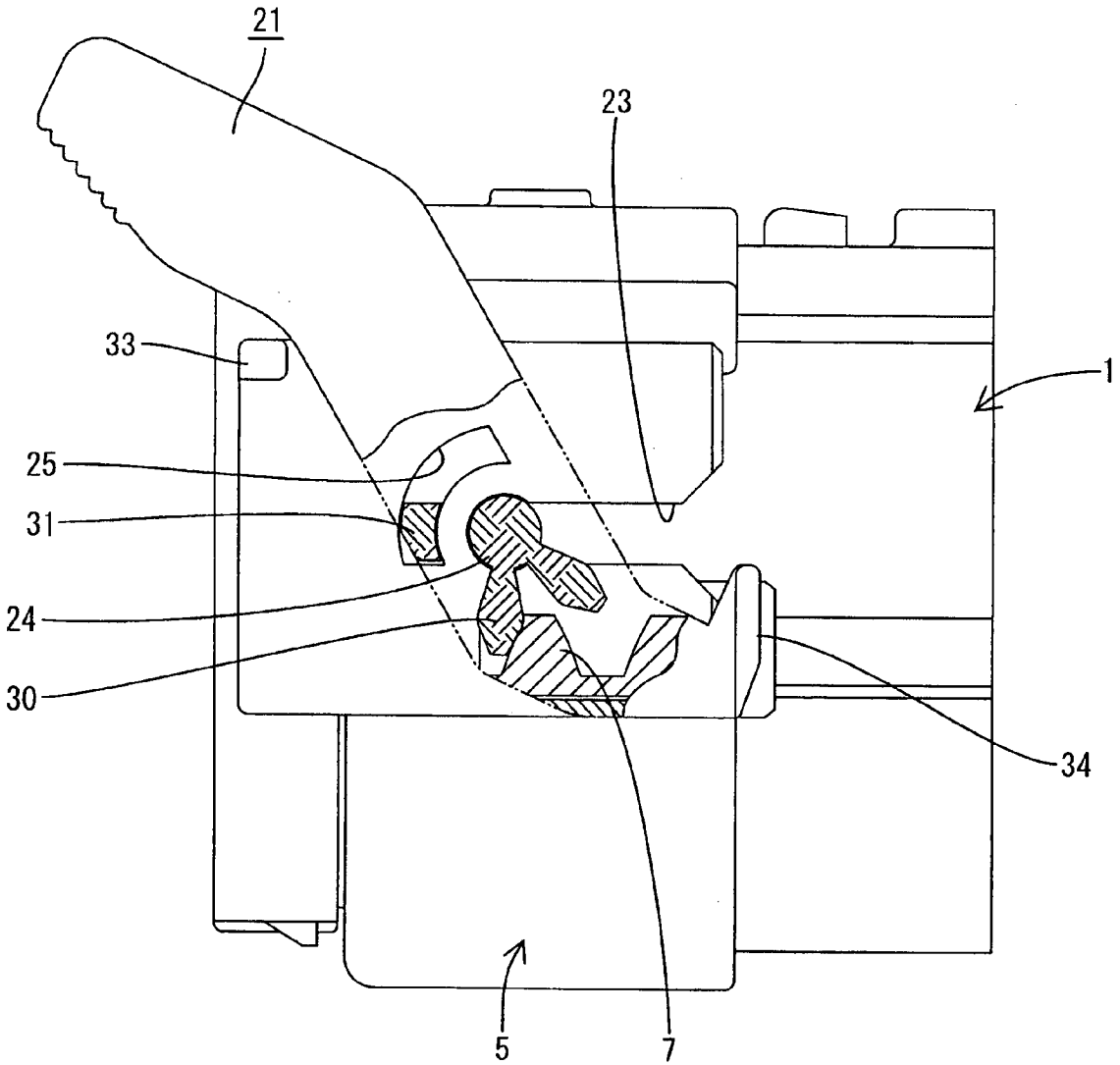
FIG. 17 is a partly broken-away side view showing a state in which the female connector and the male connector are loosely fitted in each other.
Figure 18:
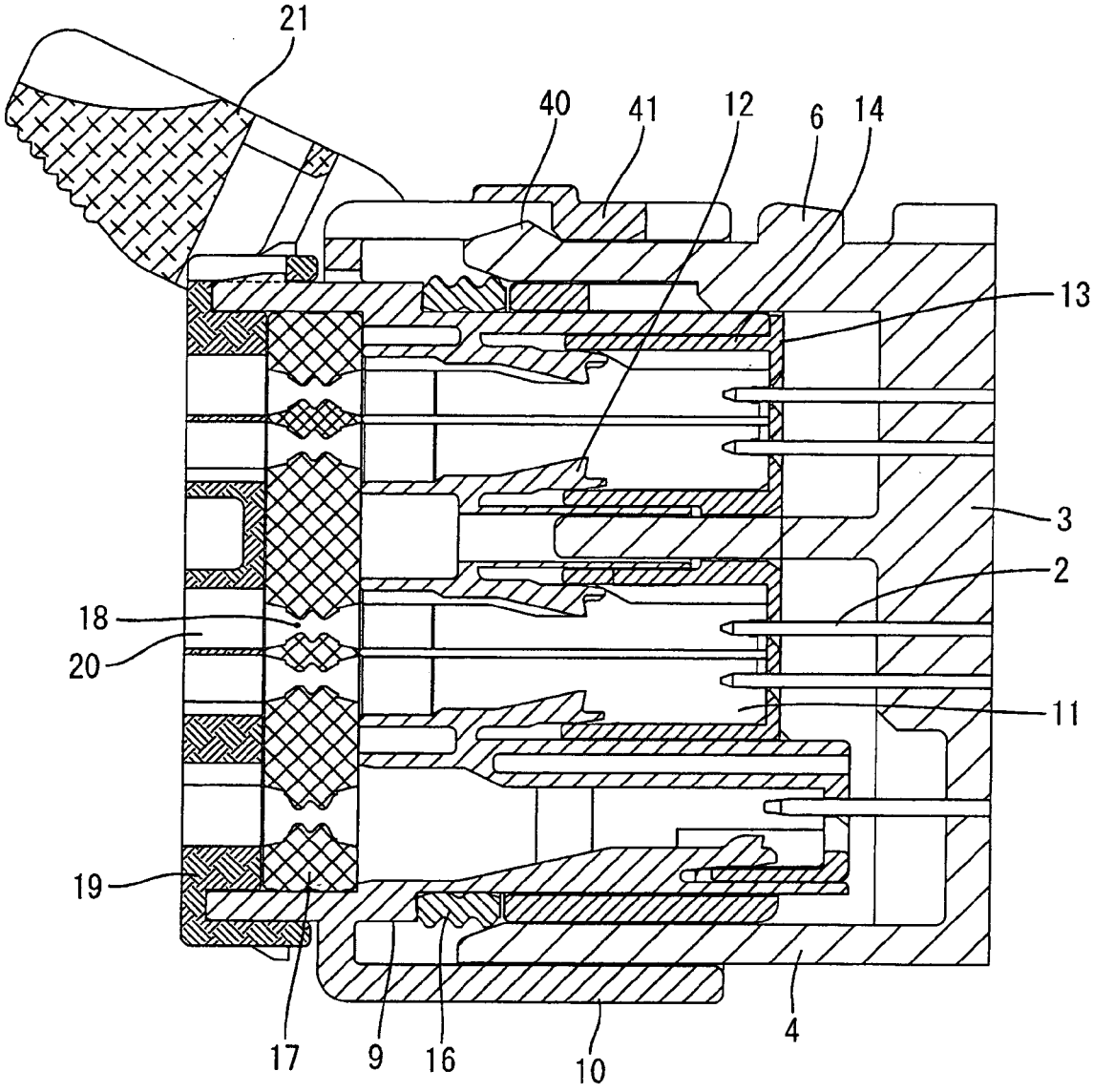
FIG. 18 is a sectional side elevation showing the state in which the female connector and the male connector are loosely fitted in each other.
Figure 19:
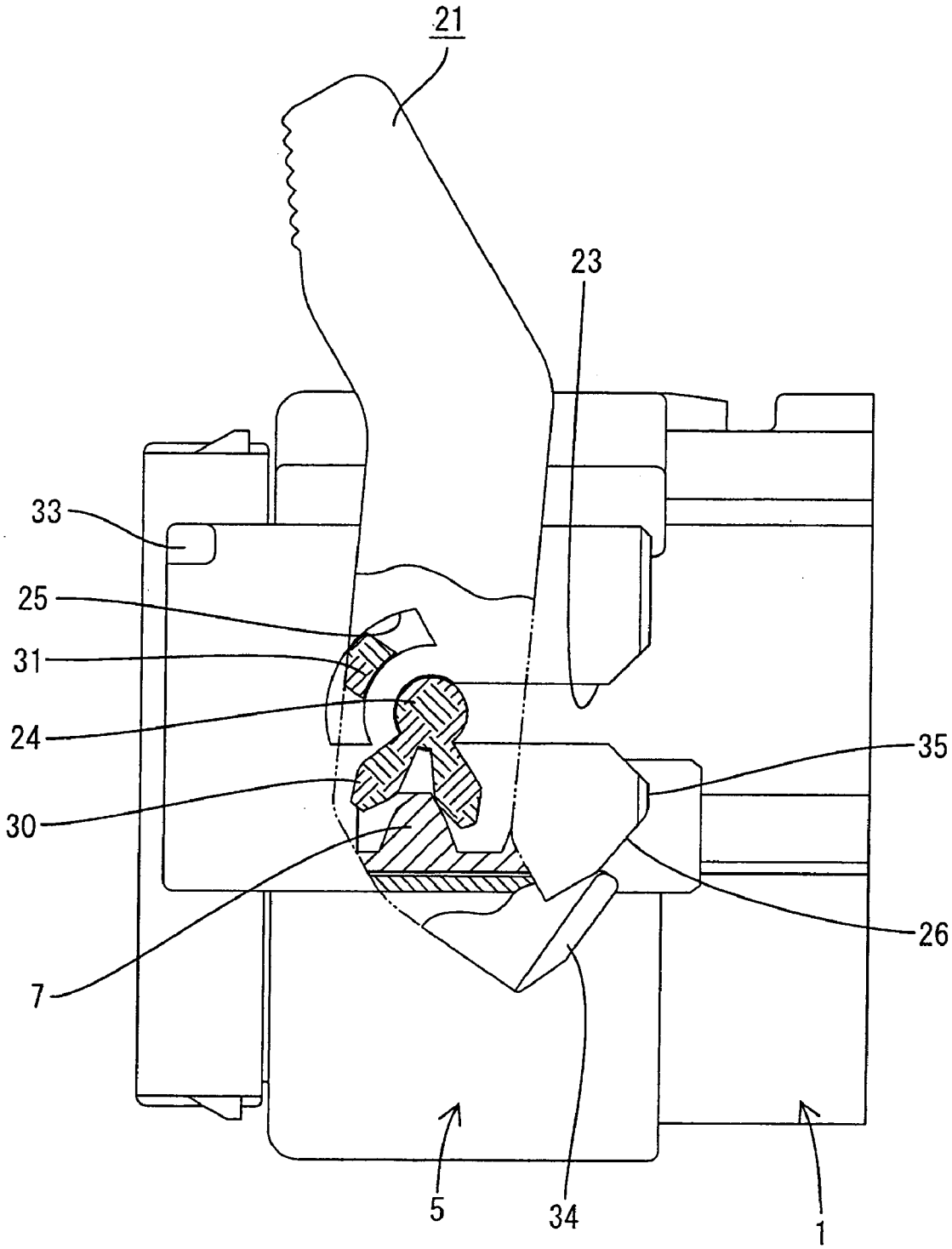
FIG. 19 is a partly broken-away side view showing a state in which an operation of rotating the lever is being performed.
Figure 20:
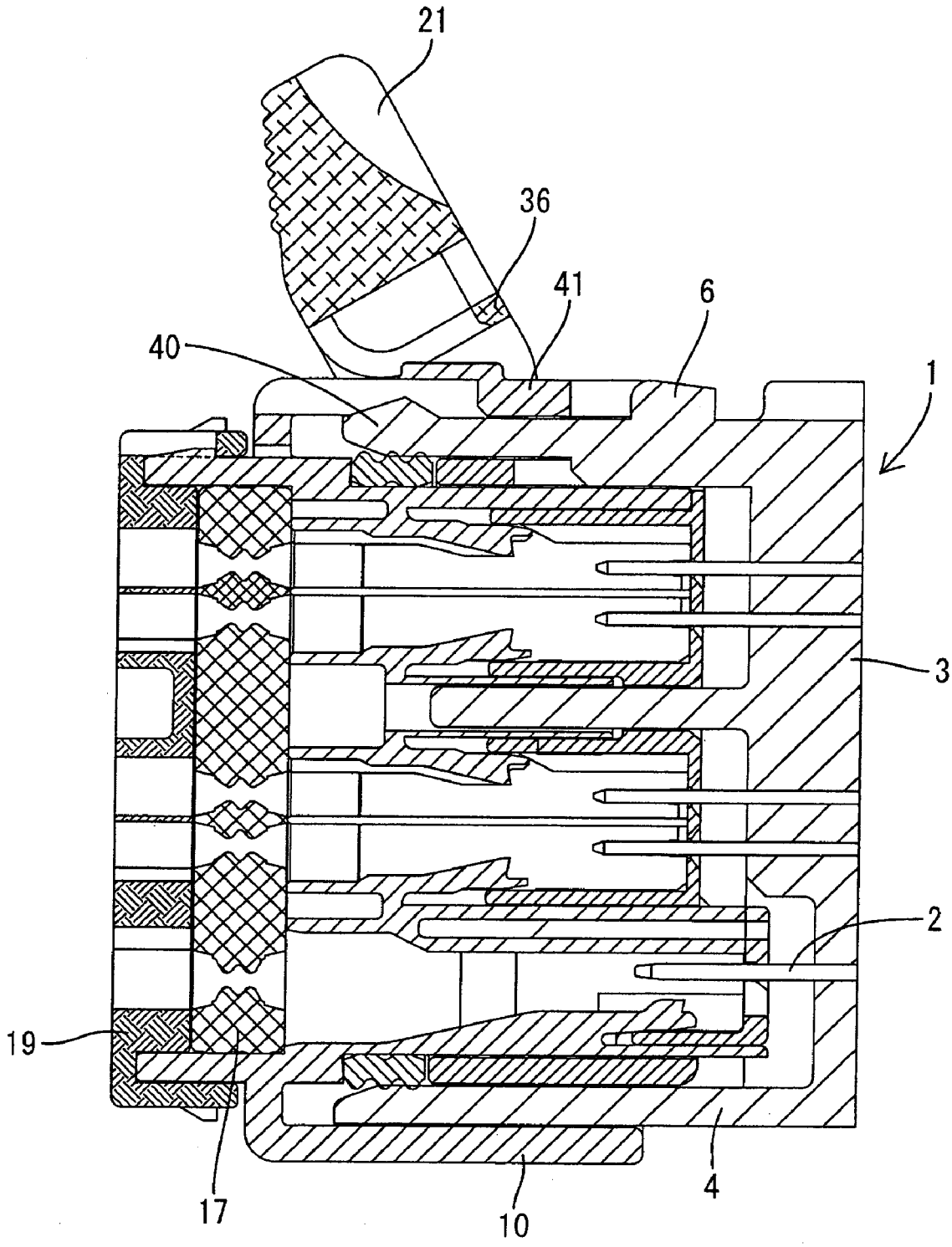
FIG. 20 is a sectional side elevation showing the state in which the operation of rotating the lever is being performed.
Figure 21:
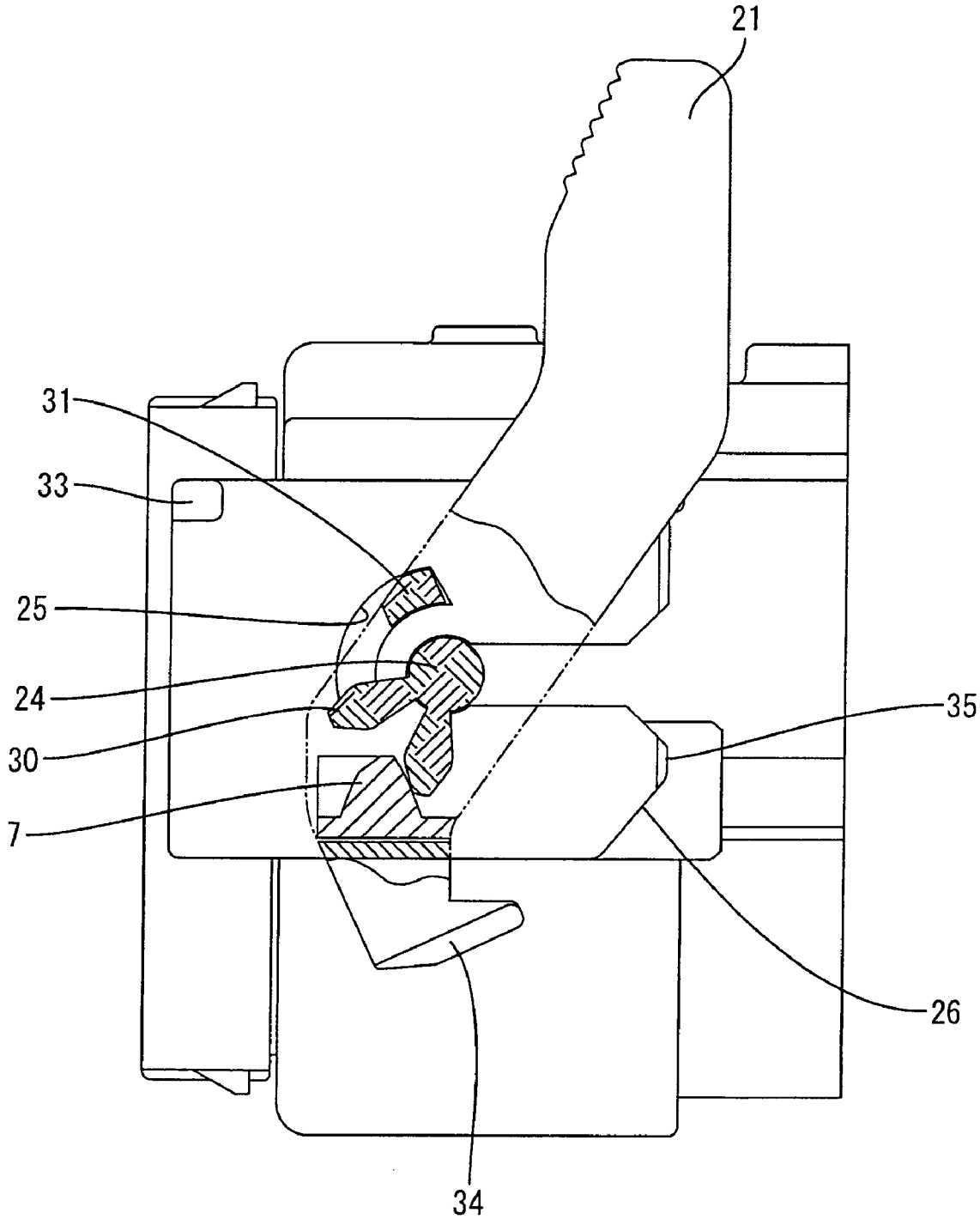
FIG. 21 is a partly broken-away side view showing a state in which the female and male connectors are completely fit together by rotating the lever to a locking position.

The female housing 5 of the female connector has a female terminal accommodation portion 9 and an outer casing 10 disposed around and the entire peripheral surface the female terminal accommodation portion 9. Cavities 11 penetrate longitudinally through the female terminal accommodation portion 9 in positions corresponding to the male terminal fittings 2 and a flexible lance 12 is formed in each cavity 11 for locking a corresponding female terminal fitting (not shown) therein. A cap-shaped retainer 13 is fit on a front surface of the female terminal accommodation portion 9 (see FIG. 16). The retainer 13 has a front plate 13A for closely contacting the front surface of the female terminal accommodation portion 9. Male terminal fitting insertion holes 13B penetrate through the front plate 13A and communicate with the respective cavities 11. The retainer 13 is movable between a temporary locking position and a main locking position. A locking plate 14 projects in from the front plate 13A of the retainer 13 and penetrates into a flexible space of the lance 12 when the retainer 13 is at the main locking position. Thus, the locking plate 14 prevents the lance 12 from flexing in a direction to unlock the female terminal fitting. At the temporary locking position, each locking plate 14 is disposed forward from the flexible space of the lance 12 to thereby allow the lances 12 during insertion and pull-out of the female terminal fittings.

The outer casing 10 is connected with the female terminal accommodation portion 9 at four corners of a rear portion thereof. A fit-in space 15 is formed between the female terminal accommodation portion 9 and the outer casing 10 for receiving the hood 4 of the male housing 1. A rubber ring 16 is fit inside the outer casing 10 and on the periphery of a rear portion of the female terminal accommodation portion 9. The rubber ring 16 closely contacts an inner surface of the hood 4 when the male housing 1 and the female housing 5 are fit together to seal the gap between the housings 1 and 5. A peripheral edge of a rear end of the retainer 13 and a front surface of the rubber ring 16 confront each other when the retainer 13 is at the main locking position to prevent the rubber ring 16 from being removed from the female terminal accommodation portion 9.

A rubber plug 17 for sealing all electric wires and female terminal fittings connected therewith is disposed in close contact with a rear surface of the female terminal accommodation portion 9. Insertion holes 18 penetrate through the rubber plug 17 and are coaxial with the respective cavities 11. The female terminal fittings can be inserted into the respective insertion holes 18. Each insertion hole 18 can closely contact the peripheral surface of a coating film of each of the electric wires. A rubber plug hold-down member 19 made of synthetic resin is disposed on a rear surface of the rubber plug 17 and is locked on the female housing 5. The rubber plug 17 can be fixed to and pressed against the rear side of the female terminal accommodation portion 9 by mounting the rubber plug hold-down member 19 on the female connector housing 5. Windows 20 penetrate through the rubber plug hold-down member 19. Each window 20 is coaxial with the corresponding insertion hole 18 and the corresponding cavity 11 and is constructed so that the corresponding female terminal fitting and the corresponding electric wire are freely insertable therein.

The connector has a lever 21 mounted in lever-mounting portions 22 formed on side surfaces of the outer casing 10 in its widthwise direction. Each lever-mounting portion 22 is in the shape of a forwardly open bag. The inside of the lever-mounting portion 22 communicates with the fit-in space 15 and the engaging tooth 7 can penetrate therein when the male and female housings 1 and 5 are fit together.

An introduction groove 23 is formed longitudinally on a side surface of each of the lever-mounting portions 22. One end of the introduction groove 23 is open towards the front of the female housing 5 to form an insertion opening 23A into which a rotary shaft 24 of the lever 21 can be inserted. A holding portion 23B is formed at the rear end of the introduction groove 23 is formed in the shape of a circular arc for rotatably holding the rotary shaft 24 of the lever 21. Circular arc-shaped locking grooves 25 penetrate through the side surfaces of the lever-mounting portions 22 at locations rearward of and coaxial with the holding portion 23B. A tapered escape edge 26 is formed at a front of the lever-mounting portion 22 and below the introduction groove 23. The escape edge 26 prevents the lever 21 from interfering with the lever-mounting portion 22 when the lever 21 is rotated. A horizontal fit-in groove 27 is formed on an inner surface of the lever-mounting portion 22 at a location rearward of the escape edge 26. The guide piece 8 of the male connector housing 1 can fit in the fit-in groove 27 when the male and female housings 1 and 5 are fit together.

The lever 21 has two side plates 28 confronting the side surfaces of the lever-mounting portion 22. The lever 21 further includes an operation portion 29 connecting upper ends of the side plates 28 to each other. A pin-shaped rotational shaft 24 projects orthogonally from an inner surface of each of the side plates 28. Two gear pieces 30 project radially out from a front end of the rotary shaft 24. The gear pieces 30 engage the engaging tooth 7 of the male connector as the lever 21 is rotated and move the female and male housings 5 and 1 in a fit-in direction. A projection 31 is formed on the side plate 28 near the rotary shaft 24. The projection 31 is movable with the rotary shaft 24 along the introduction groove 23. The projection 31 then rides over a portion of an outer surface of the lever-mounting portion 22 between the holding portion 23B and the locking groove 25 as the rotary shaft 24 approaches the holding portion 23B. The projection 31 then fits into the locking groove 25 to prevent the lever 21 from returning in a direction opposite to a lever-mounting direction. Additionally, the lever 21 can slide along the locking groove 25 while the lever 21 is being rotated.

Figure 12:
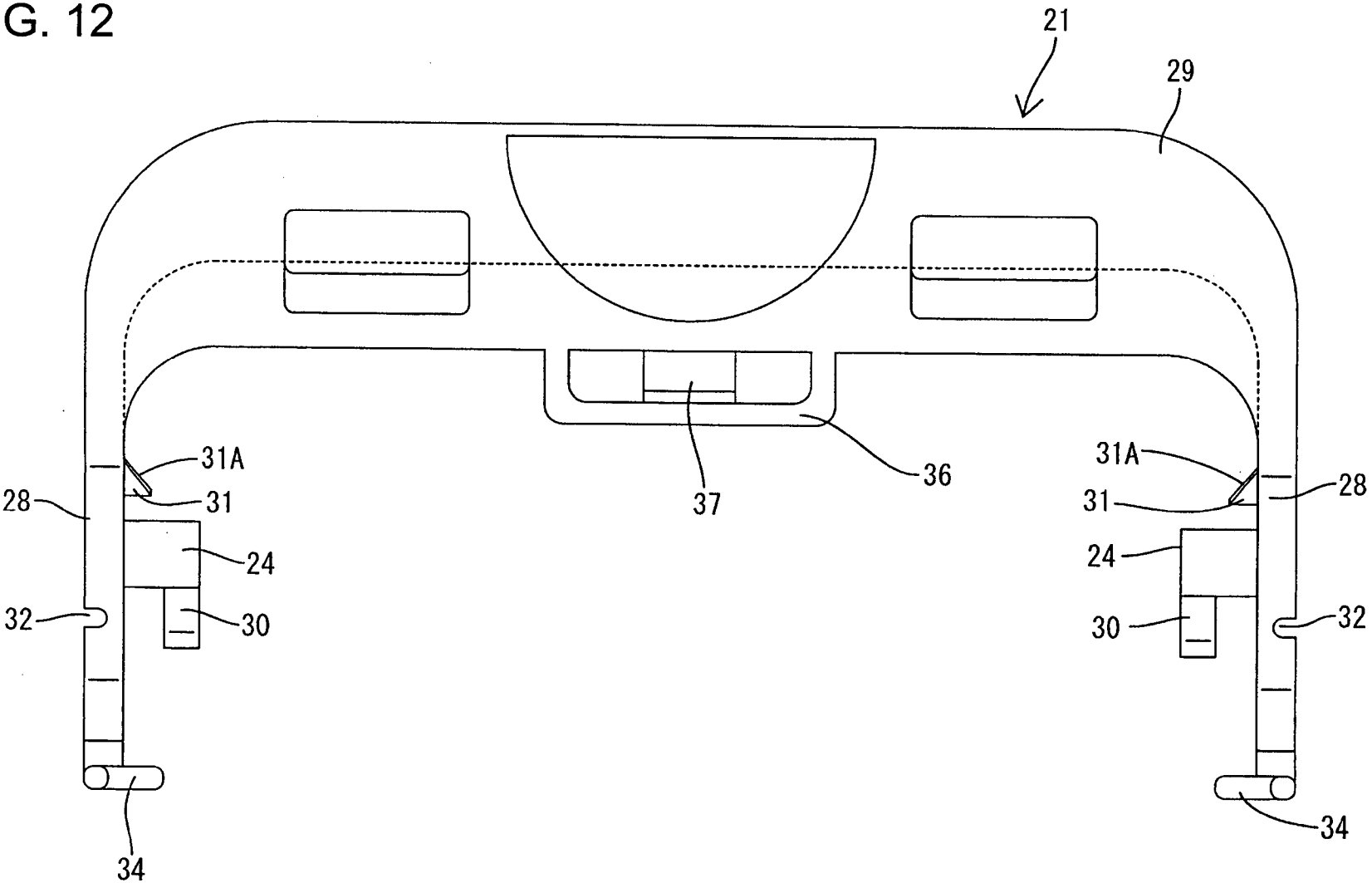
FIG. 12 is a plan view showing a lever.
Figure 13:
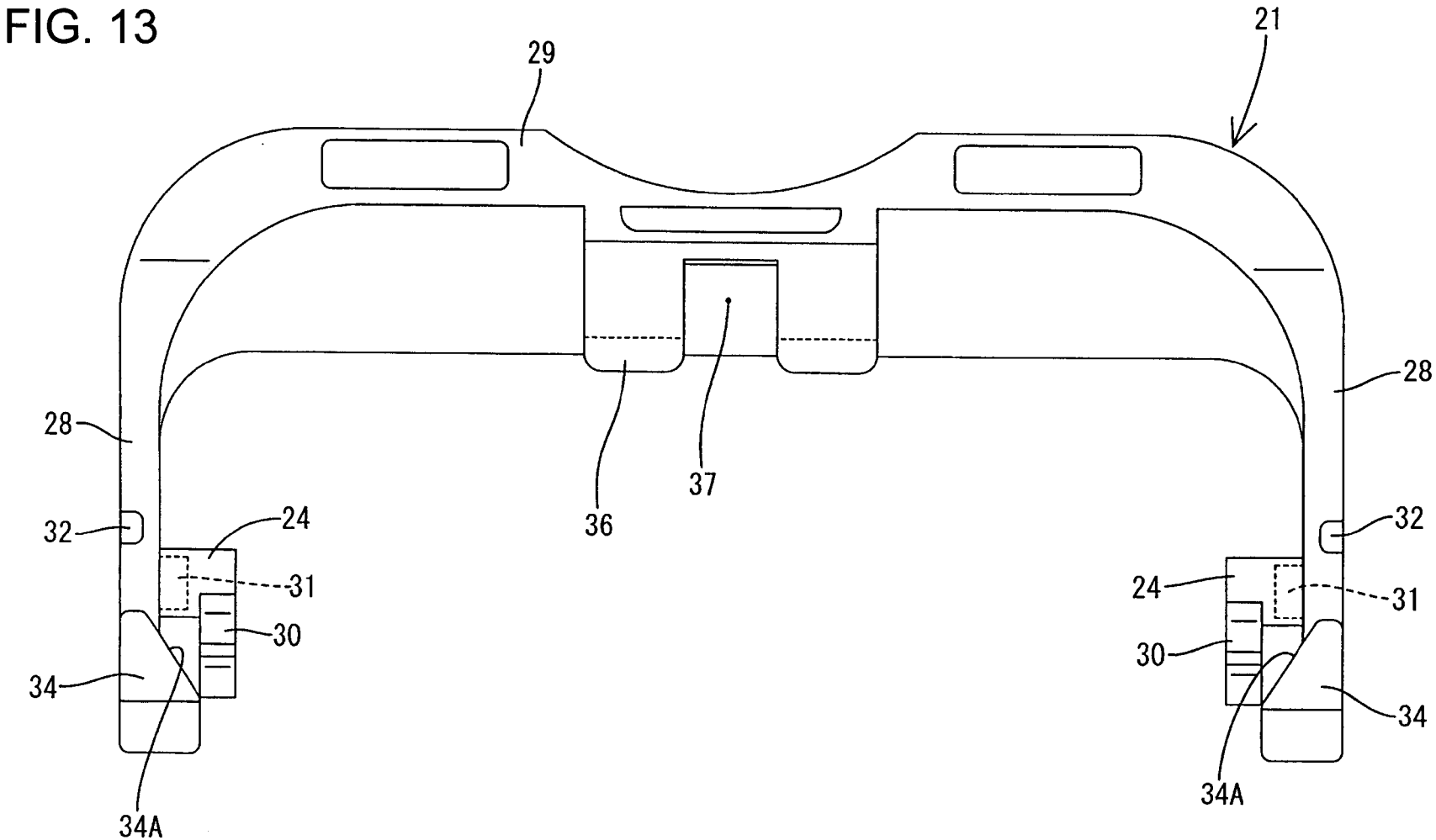
FIG. 13 is a front view showing the lever.
Figure 14:
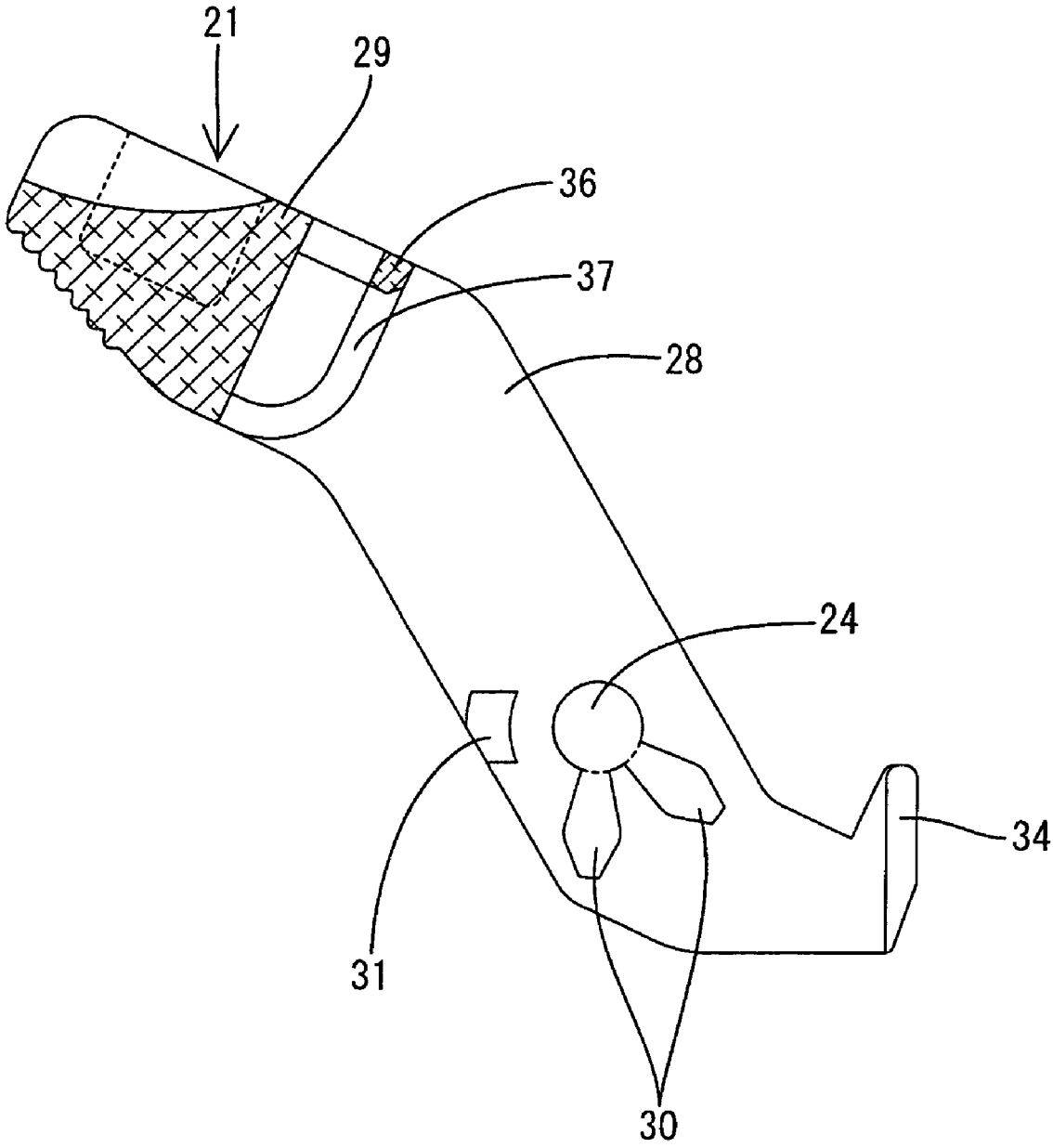
FIG. 14 is a sectional side elevation showing the lever.

An inclined surface 31A (see FIG. 12) is formed on the rear of the projection 31 to allow the projection 31 to ride smoothly from the introduction groove 23 to the locking groove 25 (see FIG. 12).

Figure 15:
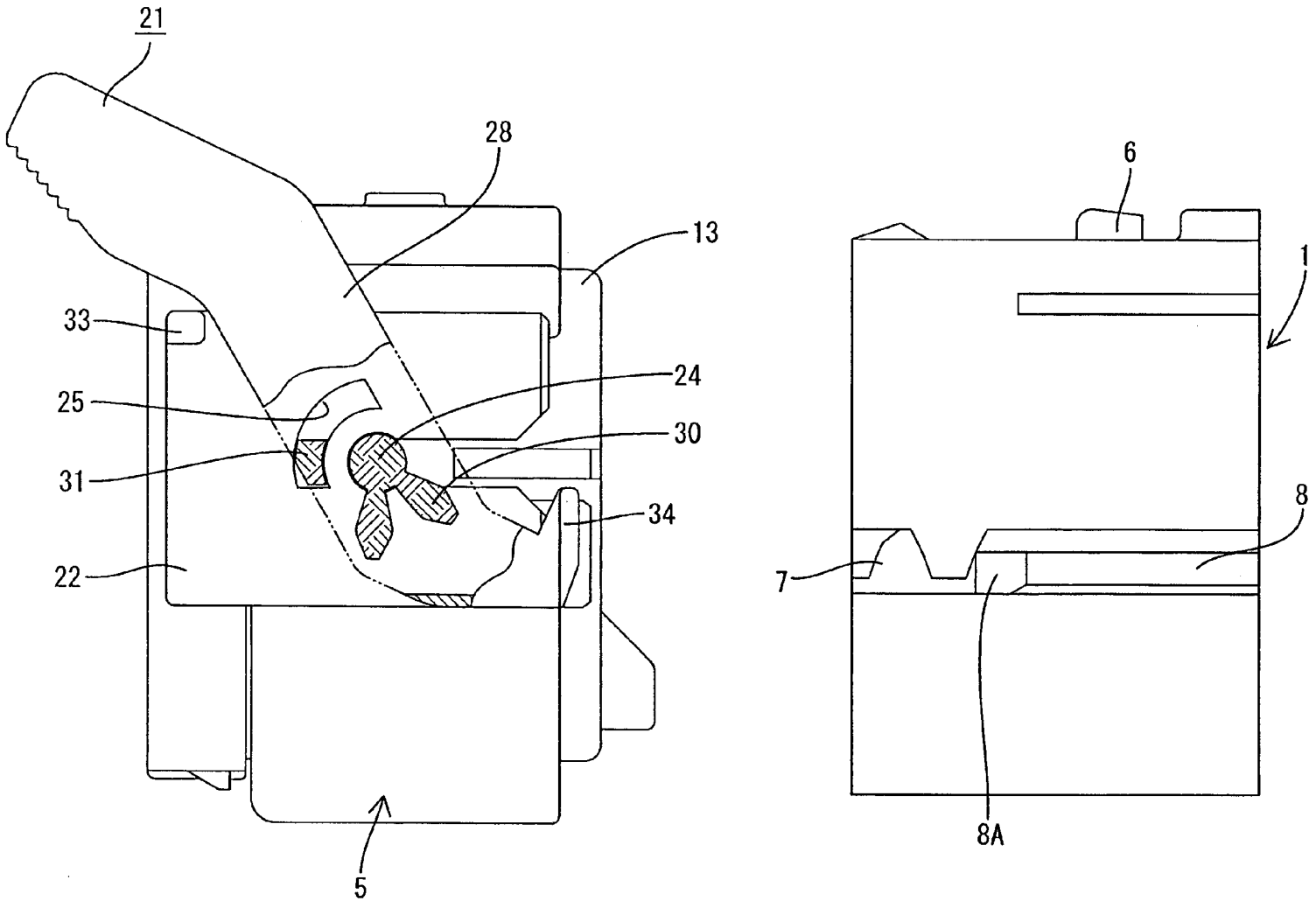
FIG. 15 is a partly broken-away side view showing a state before the female connector and the male connector are fit together.

A concave groove 32 is formed on an outer surface of the side plate 28 forward of the rotary shaft 24 is disposed. The groove 32 is formed vertically entirely on the outer surface of the side plate 28 so that a portion of the side plate 28 forward of the concave groove 32 can deform easily when the lever 21 is at the position shown in FIG. 15.

Figure 22:
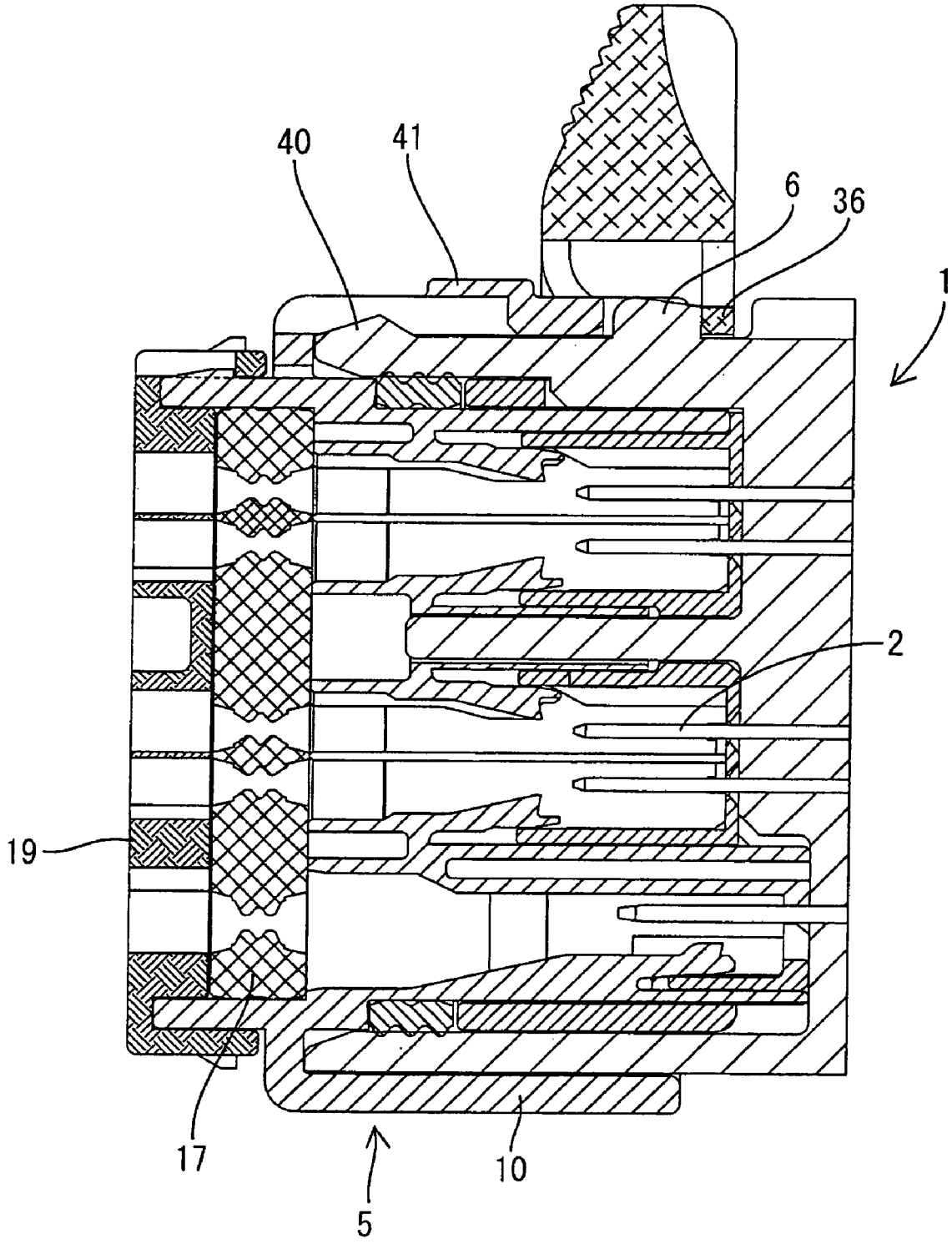
FIG. 22 is a sectional side elevation showing the state in which the female and male connectors are fit completely together by rotating the lever to a locking position.

A stopper 33 projects out from a corner of a rear upper end of the outer surface of each lever-mounting portion 22. The stoppers 33 engage side edges of both side plates 28 of the lever 21 when the lever 21 is mounted on the female housing 5 in the lever-mounting position shown in FIG. 15. The stoppers 33 prevent the lever 21 from rotating counterclockwise from the lever-mounting position shown in FIG. 15. Opposed front plates 34 project in from the front ends of the side plates 28 of the lever 21. Holding surfaces 35 are formed at a front edge of the lever-mounting portion 22 continuous with an upper end of the escape edge 26. The front plates 34 contact the holding surfaces 35 when the lever 21 is at the lever-mounting position, and the frictional force of this contact loosely prevents rotation of the lever 21 in a clockwise direction shown in FIG. 15. The front plate 34 covers a part of the front surface of the fit-in groove 27 when the lever 21 is at the lever-mounting position. Therefore the front plate 34 interferes with the guide piece 8 at the start of the operation of fitting the male and female housings 1 and 5 together. More specifically, an inclined edge 34A of the front plate 34 slidably contacts a tapered surface 8A of the guide piece 8 to open the front plate 34 of the lever 21 outward about the concave groove 32. Thus, it is possible to release the state in which the front plate 34 contacts the holding surface 35 under pressure. A lever-lock 36 is formed at a central position of the operation portion 29 of the lever 21 in the widthwise direction. A locking concavity 37 is formed at a portion between the bifurcated lever-lock 36. The locking projection 6 is locked to the locking concavity 37 when the male and female housings 1 and 5 are fit together at a normal position by rotating the lever 21. Thus, the lever 21 is locked loosely at the locking position shown in FIG. 22.

The female housing 5 can be fit shallowly on the hood 4 of the male housing 1 with the lever 21 at the lever-mounting position. At this time, the engaging tooth 7 of the male housing 1 penetrates into the lever-mounting portion 22 of the female housing 5 from the front and contacts one of the gear pieces 30 of the lever 21 so that the engaging tooth 7 is between both gear pieces 30. At the same time, the tapered surface 8A of the guide piece 8 slidably contacts the inclined edge 34A of the front plate 34 of the lever 21 and deforms the front plate 34 outward about the concave groove 32. Thus, the front plate 34 is released from the holding surface 35, the lever 21 is released from the lever-mounting position and the entrance of the fit-in groove 27 is released so that the lever 21 can be rotated. The engagement between the gear pieces 30 of the lever 21 and the engaging tooth 7 of the male connector housing 1 urges the male and female housings 1 and 5 together as the lever 21 is rotated.

The locking projection 6 is locked to the locking concavity 37 when the lever 21 reaches the locking position. The lever 21 is held at the locking position and the male and female terminal fittings are connected to each other at a normal state.

The lever 21 is positioned forward of the female housing 5 in preparation for mounting. The rotary shafts 24 of the lever 21 and the projection 31 then are inserted through the insertion opening 23A of the introduction groove 23. The entire lever 21 in this posture then is pressed into the introduction groove 23. Thus, the inner surfaces of the side plates 28 slide in contact with the outer surface of the lever-mounting portion 22 without the side plates 28 deforming outward. The projection 31 passes through the holding portion 23B and rides over the outer surface of the lever-mounting portion 22 immediately before the rotary shaft 24 reaches the holding portion 23B at the end of the introduction groove 23. The projection 31 fits into the locking groove 25 when the rotary shaft 24 has reached the holding portion 23B. In this manner, the projection 31 locks in the locking groove 25 and prevents a return of the lever 21. Further both gear pieces 30 are locked to the rear side of the introduction groove 23. Thus, the lever 21 is mounted on the female housing 5 while preventing the side plates from being opened outward. The rotary shaft 24 and the projection 31 are guided into the introduction groove 23 while the lever 21 is being mounted on the female housing 5. Thus the lever 21 is prevented from rotating and the posture of the lever 21 is fixed. Accordingly, the lever 21 is at the lever-mounting position when the lever 21 is mounted completely on the female housing 5. That is, the side plate 28 of the lever 21 and the stopper 33 of the female housing 5 contact each other, and the front plate 34 contacts the holding surface 35 under pressure. Thus the lever 21 is held at the lever-mounting position and is prevented from rotating in both directions. Therefore, it is unnecessary to perform work for adjusting the lever 21 to the lever-mounting position before filling the male and female housings 1 and 5 together.

As described above, the lever 21 is mounted on the lever-mounting portion 22 merely by sliding the lever 21 along the lever-mounting portion 22 and without opening the side plates 28. Therefore, the lever-mounting operation is performed smoothly and simply.

The invention is not limited to the embodiment described above with reference to the drawings. For example, the following embodiments are included in the technical scope of the present invention. Further, various modifications of the embodiments can be made without departing from the spirit and scope of the invention.

The illustrated lever 21 has side plates 28 at both sides of the operation portion 29, but the lever may have only one side plate at one side of the operation portion.

The engaging tooth is the force exertion portion and the projected portion for preventing the lever from opening outward. However, the force exertion portion can be separate from the projected portion.

When the force exertion portion is formed separately from the projected portion, the force exertion portion may be a known cam groove and cam pin.

What is claimed is:

1. A connector comprising:

a first housing formed with a receiving portion;

a second housing that can be fit together with the first housing, at least one lever-mounting portion provided on said second housing, an introduction groove penetrating through said lever-mounting portion and extending along a lever-mounting direction, said introduction groove having an open end and a closed end, and an opening penetrating through said lever-mounting portion at a location rearward of said closed end of said introduction groove; and a lever having an operation portion and at least one side plate extending from the operation portion, a rotary shaft extending from a location on the side plate spaced from the operation portion and rotatably disposed at the closed end of the introduction groove, a projection extending from said side plate at a location spaced from the operation portion and from the rotary shaft, the projection being locked in the opening penetrating through said lever-mounting portion for preventing removal of the lever through the introduction groove in a direction opposite the lever-mounting direction, while permitting rotation of the lever about the rotary shaft, a force exertion portion on said lever for engaging the receiving portion on the first housing to displace said housings in a fit-in direction during rotation of said lever.

2. The connector of claim 1, wherein said force exertion portion comprises at least a first engaging tooth projecting radially out from said rotary shaft.

3. The connector of claim 2, further comprising an accommodation space formed between said lever-mounting portion and an outer surface of said second housing for receiving the engaging tooth.

4. The connector of claim 3, wherein said receiving portion comprises at least a second engaging tooth on said first housing, said second engaging tooth being configured for entering said accommodation space when said housings are fit together, said first and second engaging teeth engaging one another when said housings initially are fit together, and said first and second engaging teeth cooperating when said lever is rotated to move said housings into a fully connected condition.

5. The connector of claim 1, wherein the at least one lever-mounting portion comprises first and second lever-mounting portions disposed respectively on opposite respective sides of the second housing.

6. The connector of claim 5, wherein the lever has first and second side plates extending from opposite ends of the operation portion, each of said side plates having one of said rotary shafts.

7. The connector of claim 6, wherein the side plates of the lever are disposed outwardly of the lever-mounting portions, the rotary shafts projecting towards one another from inwardly facing surfaces of the side plates.

8. The connector of claim 7, wherein each of said side plates has one of said projections, the projections projecting towards one another from inwardly facing surfaces of the side plates.

9. The connector of claim 1, further comprising a front plate projecting from an end of said side plate of the lever opposite the operation portion, the front plate being configured to engage the second housing for releasably holding the lever in a position for connecting the first and second housings.

10. The connector of claim 1, wherein the opening in the lever-mounting portion is arcuate and substantially concentric with the closed end of the introduction groove.

11. The connector of claim 1, further comprising a groove formed in the side plate of the lever between the rotary shaft and a free end of the side plate for facilitating deflection of the side plate so that the lever can be mounted on the second housing and held releasably at a position for connection with the first housing.

12. The connector of claim 1, further comprising means for releasably holding the lever in a position for engaging the force exerting portion of the lever with the receiving portion of the first housing.

13. A connector comprising:

a first housing formed with opposite first and second side surfaces and first and second receiving portions formed respectively on the side surfaces;

a second housing configured for connecting with the first housing, the second housing having opposite first and second side surfaces and first and second lever-mounting portions provided respectively on the side surfaces of said second housing, an introduction groove penetrating through each said lever-mounting portion and extending along a lever-mounting direction, each said introduction groove having an open front end and a closed rear end, and an opening penetrating through each said lever-mounting portion at a location rearward of the respective closed end of said introduction groove; and a lever having an operation portion and first and second side plates extending from opposite ends of the operation portion, a rotary shaft extending from a location on each of the side plates spaced from the operation portion and rotatably disposed at the closed rear end of the respective introduction groove, a projection extending from each of said side plates at location spaced from the respective operation portion and from the respective rotary shaft, the projections being locked in the openings penetrating through said lever-mounting portions for preventing removal of the lever through the introduction grooves in a direction opposite the lever-mounting direction, while permitting rotation of the lever about the rotary shafts, force exertion portions on the respective side plates of said lever for engaging the receiving portions on the first housing to displace said housings in a fit-in direction during rotation of said lever.

14. The connector of claim 13, wherein each said force exertion portion comprises at least two first engaging teeth projecting radially out from the respective rotary shafts.

15. The connector of claim 14, further comprising first and second accommodation spaces formed between the respective lever-mounting portion and an outer surface of said second housing for receiving the engaging tooth.

16. The connector of claim 15, wherein said receiving portions comprise at least two second engaging teeth on said first housing, said second engaging teeth being configured for entering said accommodation space when said housings are fit together, said first and second engaging teeth engaging one another when said housings initially are fit together, and said first and second engaging teeth cooperating when said lever is rotated to move said housings into a fully connected condition.

17. The connector of claim 13, further comprising first and second front plates projecting respectively from end of said side plates of the lever opposite the operation portion, the front plates being configured to engage the second housing for releasably holding the lever in a position for connecting the first and second housings.

18. The connector of claim 13, wherein the openings in the lever-mounting portions are arcuate and substantially concentric with the closed rear ends of the introduction grooves.

* * * * *